United States Patent [19]

Kobayashi

[11] 4,271,093

[45] Jun. 2, 1981

[54] CARBURETOR

[75] Inventor: Takeshi Kobayashi, Kawasaki, Japan

[73] Assignee: Walbro Far East, Inc., Kawasaki, Japan

[21] Appl. No.: 90,425

[22] Filed: Nov. 1, 1979

[30] Foreign Application Priority Data

Nov. 20, 1978 [JP] Japan ..... 53-142177

[51] Int. Cl.[3] ..... F02M 1/16

[52] U.S. Cl. ..... 261/34 R; 261/35; 261/DIG. 68; 261/DIG. 8; 123/187.5 R

[58] Field of Search ..... 123/187.5 R; 261/DIG. 8, DIG. 68, 35, 34 R

[56] References Cited

U.S. PATENT DOCUMENTS

| | | | |
|---|---|---|---|
| 1,116,823 | 11/1914 | Johnson et al. | 261/DIG. 8 |
| 2,713,854 | 7/1955 | Conover | 261/DIG. 68 |
| 3,177,920 | 4/1965 | Phillips | 261/34 R |
| 3,233,652 | 2/1966 | Phillips | 261/34 R |
| 3,275,305 | 9/1966 | Nutten | 261/DIG. 8 |
| 3,371,658 | 3/1968 | Turner | 123/187.5 R |
| 3,738,622 | 6/1973 | Tuckey | 261/DIG. 68 |
| 3,987,775 | 10/1976 | O'Connor | 123/187.5 R |
| 4,197,825 | 4/1980 | Altenbach | 261/DIG. 8 |

*Primary Examiner*—Tim R. Mils

*Attorney, Agent, or Firm*—Barnes, Kisselle, Raisch & Choate

[57] ABSTRACT

A carburetor having a fuel pump connected to a fuel supply, a fuel inlet valve, a diaphragm-controlled fuel chamber, and a diaphragm to control said fuel inlet valve in response to sub-atmospheric engine pulses, with a manually operable resilient pressure dome to create a sub-atmospheric pressure in the fuel chamber to move said diaphragm to an inlet valve open position and pull fuel into said chamber from a fuel supply to prime said carburetor for cold starts or restarts after fuel depletion.

1 Claim, 1 Drawing Figure

CARBURETOR

FIELD OF INVENTION

Diaphragm carburetor with manual primer.

BACKGROUND OF INVENTION

This invention relates to an improved carburetor to be mounted on a two-cycle engine to provide a power source for chain saws, trimmers and weed cutters and the like.

It is an object to provide a carburetor with a suction priming system which can draw fuel into the diaphragm control chamber prior to starting or following a fuel runout.

It is a further object to provide a carburetor as described which can be used on chain saws, trimmers, weed cutters and the like so designed that it can operate in upright or other positions such as upside down and side positions—in other words, an all-position carburetor. For this reason, the carburetor is designed with a pressure chamber mechanism to insure that the pressurized fuel flow from the pump to the fuel jets is accurately controlled regardless of the carburetor positions, this being done in connection with a pulse link between the engine and the diaphragm chamber.

Diaphragm carburetors in general have a diaphragm chamber which opens to the main jet and the idling jet orifices, there being a diaphragm in the diaphragm chamber which controls a fuel inlet valve which is interposed between a pulse fuel pump and the diaphragm chamber.

In the operating phase of the engine, the diaphragm continually opens and closes the inlet needle so that fuel can enter the diaphragm chamber in response to suction pulses of the engine. The pressure pulse is being isolated from the diaphragm chamber by check valves. Accordingly, a certain amount of fuel can be maintained in the diaphragm chamber at a fixed pressure, and the fuel then flows from the diaphragm chamber to the fuel jet orifices depending on the position of a throttle valve. As previously pointed out, where insufficient fuel is maintained in the chamber during the starting phase, for example, in a cold climate or trying to restart an engine which has run out of fuel, it is important to refill the fuel in the diaphragm chamber.

It is, therefore, an object of the present invention to provide a primer system which can be actuated manually prior to the starting or restarting of the engine to create a suction, that is, a sub-atmospheric pressure, in the diaphragm chamber and cause the resulting motion of the diaphragm to open the fuel valve and cause fuel to flow into the diaphragm chamber for starting purposes. After the engine is started, the pressure pump will function to provide the fuel supply and the manual suction system will be automatically cut out. Nevertheless, when the engine is not running, there is no suction applied to the diaphragm chamber and the inlet needle remains in its closed position and it will remain so until the engine is started or until the manual priming system is actuated. The primer can also be used to remove excessive fuel from the diaphragm chamber should this be desirable. Suitable check valves are provided in the primer system to achieve the required sub-atmospheric pressure to accomplish this.

It is, therefore, an object to provide a relatively simple construction in a carburetor to accomplish the above objects in connection with the fuel supply and the priming system.

As explained above, by providing the manually operated suction priming system, it is no longer necessary to actuate the diaphragm manually from the outside of the carburetor. The fuel inlet valve in the form of a needle valve which works in conjunction with linkage attached to the diaphragm is moved by resilient spring pressure acting on the linkage to close in the direction of the fuel inlet flow. In addition, it is noteworthy that the fuel can be sucked into the diaphragm chamber when the fuel supply pump is not operating. As an illustration of a carburetor designed to perform the above-described objects, a detailed explanation is provided in connection with the single drawing.

BRIEF DESCRIPTION OF THE DRAWINGS

A sectional view of the carburetor in accordance with the present invention showing the fuel and air passage, the diaphragm control chamber, the fuel supply pump and the suction priming system.

DETAILED DESCRIPTION OF THE INVENTION

Figure 1:
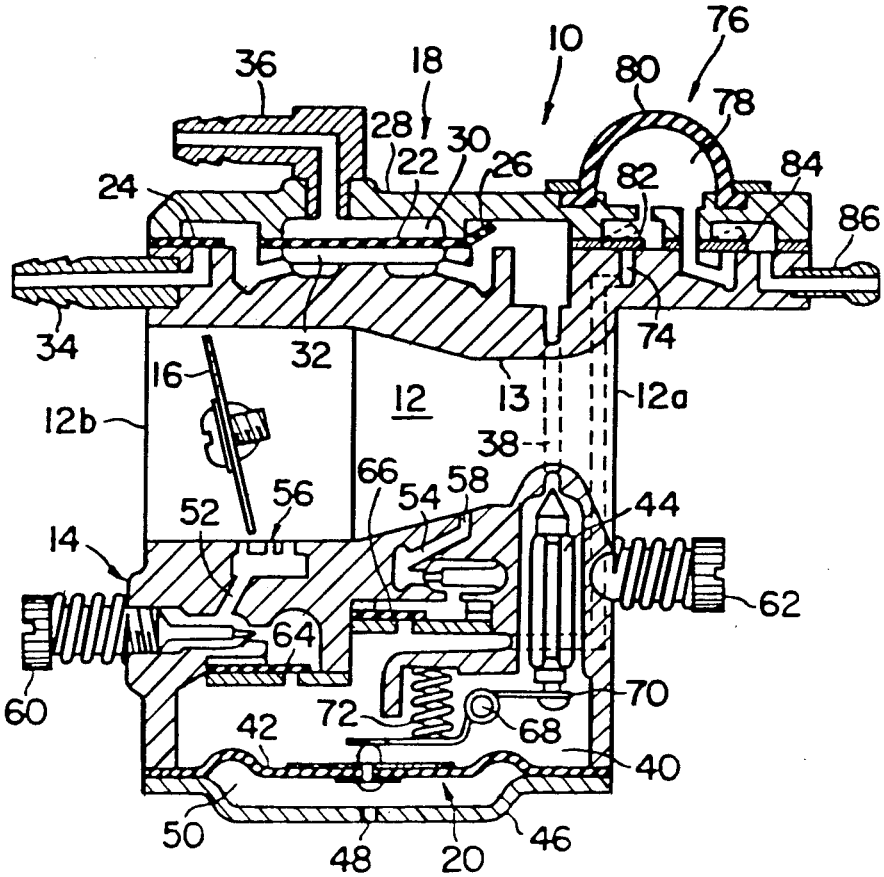

A carburetor 10, as shown in the drawing, includes a carburetor body 14 which has an air passage 12 controlled by a throttle valve 16. The entrance end 12*a* of the air passage 12 provides a suitably filtered air inlet for the carburetor and the other end of the air passage 12*b* leads to the fuel and air mixture inlet of the internal combustion engine on which the carburetor is mounted. The air and fuel passage 12 has a venturi portion 13 of standard construction open to the air inlet.

A fuel supply pump 18 is provided at the top of the carburetor body as illustrated which operates to supply fuel from a tank not shown and a pressure control mechanism 20 which is generally a diaphragm controlled chamber controls the flow of fuel at a constant pressure from the pump to the main fuel jets and idle jets to be referenced more specifically later. The fuel pump 18 is a diaphragm pump of standard known construction provided with a diaphragm 22 and inlet and outlet check valve 24 and 26. The diaphragm 22 is captured between the carburetor body 14 and the cover plate 28 affixed to the carburetor body. There are chambers on each side of the diaphragm 22, there being a chamber 30 on the cover side and a chamber 32 on the carburetor body side. The pumping chamber 32 is connected with the fuel tank to a nipple connection 34 and the working pressure, namely, the engine pulses are transmitted to the working chamber 30 through a connecting nipple 36 mounted in the cover 28. In a two-cycle engine, for example, the nipple 36 will be connected to the crankcase to conduct pulses from the crankcase to the chamber 30.

With the engine running, the pump 18 will bring fuel through the inlet check valve 24 to the chamber 32 and out of the outlet check valve 26 leading to a fuel well having a flow passage 38 connecting to a valve seat controlled by an inlet valve 44. The diaphragm chamber mechanism illustrated generally at 20 consists of a main diaphragm 42 that forms a fuel chamber 40 which receives fuel from the pump 18 and the passage 38 through the previously referenced inlet valve 44. The inlet valve operates intermittently to open and close the valve seat at the bottom end of the passage 38. The diaphragm 42 is captured peripherally between the lower portion of the carburetor body 14 and the closing cover 46 affixed to the carburetor body. This forms an atmospheric chamber 50 below the diaphragm exposed to atmosphere through an opening 48 on the cover 46.

The diaphragm chamber 40, which is the fuel supply chamber, is open to the fuel and air mixture passage 12 through two supply passages 52 and 54. The supply passage 52 opens to the passage 12 through a plurality of openings 56 adjacent the throttle valve 16 and the main jet passage 54 opens to the air inlet through the passage 58. The idle ports 56 can be three in number in a standard construction. The adjustment of each of the jets, that is, the main jet and the idle jets, can be regulated by adjusting screw 60 for the idle jets and the main jet 58. A check valve 64 and 66 are provided for the respective fuel supply openings to prevent the engine pressure pulses from reaching the chamber 40. When the engine is running and the throttle vavle 16 is at the idling position, the check valve 66 functions to intercept the air current toward said diaphragm chamber 40 from the main port 58.

Also, when the primer, which is to be described later, is being actuated, the valve 66 functions to block air from reaching the diaphragm chamber 40 from the main jet 58 and similarly the other check valve 64 will block air from the passage 12 into the diaphragm chamber 40.

In the area between the diaphragm 42 and the inlet needle valve 44, there is a mounting pin 68 which mounts a lever 70 which has one end bearing against a central portion of a diaphragm and the other end connected to the bottom of the needle valve 44. Consequently, in accordance with standard construction with diaphragm carburetors, when a strong suction pulse is transmitted from mixing passage 12 through the ports 52 and 54 to the diaphragm 42, this tends to raise the diaphragm, open valve 44, and cause fuel to flow from passage 38 into the diaphragm chamber from the pump system 18. When this suction pulse is released, by flow of fuel into the diaphragm chamber 40, the inlet valve 44 has a tendency to move to a closing position in conjunction with the coil spring 72 bearing against the lever 70.

Thus, when the internal combustion engine is running, the diaphragm chamber 40 functions as a pressure chamber which receives a certain amount of sub-atmospheric pressure continually in pulses from the engine and serves to maintain the proper amount of fuel in the pressure chamber 40. The fuel is supplied to each port 56 and 58 through the supply circuits 52 and 54 regardless of the orientation of the carburetor body 10.

Thus, the fuel supply ports will deliver the proper amount of fuel to the mixing passage 12 depending on the position of the throttle 16.

THE PRIMING CIRCUIT

When the engine is not running and therefore the pump 18 is not receiving engine pulses through the nipple connector 36, it is sometimes difficult to start the engine particularly in cold climates or under conditions where the engine has run out of fuel and the fuel chamber 40 has been exhausted of fuel. Then a primer system is advantageous because there is insufficient fuel to start the engine. In order to eliminate this difficulty, a suction inlet passage 74 is provided at the upper right portion of the drawing which opens to the chamber 40 through a passage in the carburetor body. This system is intended to move fuel into the diaphragm chamber under circumstances when the pump 18 is not working. The suction inlet opens to the outside of the carburetor 10 but the suction pump shown generally at 76 in relation to the suction inlet 74 is integrated into the carburetor 10 as shown in the drawings.

The suction pump 76 has a pump chamber 78 formed by a domed cap 80 of resilient material. Check valves 82 and 84 are provided in the sealing diaphragm between the right-hand end of cap 28 and the right-hand flange of body 14. The check valve 82 overlies the passage 74 which provides the suction inlet and this inlet is normally closed by this valve 82. Thus, air flow toward the pressure chamber is blocked in normal operation and does not affect the proper function of the diaphragm chamber when the engine is operating. However, by repeated pressing of the resilient dome 80, air can be pulled into the pump chamber 78 through the port 74 and the check valve 82 and at the same time air can be exhausted to an atmospheric opening 86 through the check valve 84.

Consequently, when the internal combustion engine is not running, it is possible to manually operate the resilient dome 80 to create a reduced pressure in passage 40 and this will cause the diaphragm 42 to raise and open the valve 44 so that fuel in the passage 38 and the fuel well above it, as well as fuel from the inlet 34, can flow into the chamber 40 despite the fact that the pump 18 is not operating. In the event an excessive amount of fuel is supplied to the pressure chamber 40 by reason of the actuation of the primer or for some other reason, this fuel can be discharged from the carburetor by the actuation of the dome 80 through the outlet 86. When fuel reaches the outlet, it will be noted that the carburetor is suitably primed. During this priming operation, the check valves 64 and 66 will remain closed, thus preventing the flow of air from the mixing passage 12 into the pumping chamber 40 and allowing a sub-atmospheric pressure to be created. While one of these check valves might be eliminated, the priming system is more efficient when they are provided. The priming system has been described in connection with a system which is integrated into the carburetor body but it might also be an independent element connected only by the required suction passage. In this connection, a check valve to close the air flow from the suction inlet 74 is to be provided to function while the engine is running. Other various suction sources might be connected with the suction inlet 74 in lieu of the manually operating suction pump 76.

By means of this invention, when the primer is being operated, the fuel can be supplied to the pressure chamber utilizing the suction pump as the source reducing the pressure in the chamber 40. This avoids the need for so-called "ticklers" for fluctuating supply pumps and also provides for an outlet for excessive fuel which can be discharged from the exhaust outlet. This makes it unnecessary to provide a check valve at the outlet and provides a simpler structure operated in connection with the primer for exhausting the excessive amounts of fuel. Consequently, in a relatively simple structure, a cold start or restart of the engine can be accomplished by a relatively simple operation of the primer.

I claim:

1. In a diaphragm carburetor having a body with a fuel supply port, a diaphragm chamber open to said fuel supply port formed in said body for supplying fuel to an internal combustion engine through main and idle fuel jets in the carburetor, a diaphragm controlled fuel inlet valve in said body connected to said fuel supply port, a pump chamber in said body, one side of which is formed by the body and the other side of which is formed by a manually compressible resilient dome sealed peripherally against said body and accessible from the outside of said body, a first passage in said body leading from the diaphragm chamber to said pump chamber having a first one-way valve opening in the direction from said diaphragm chamber to said pump chamber, a second passage in said body leading from said pump chamber to an outlet port open to atmosphere having a second one-way valve opening in the direction from said pump chamber to said outlet port, said dome being manually compressible to create a suction in said diaphragm chamber to draw a starting charge of fuel into said diaphragm chamber when said engine is not operating, said first one-way valve serving to block flow through said first passage when said carburetor is operating normally with the engine running.

* * * * *

REEXAMINATION CERTIFICATE (1406th)

United States Patent [19] [11] B1 4,271,093

Kobayashi [45] Certificate Issued Jan. 22, 1991

[54] CARBURETOR

[75] Inventor: Takeshi Kobayashi, Kawasaki, Japan

[73] Assignee: Walbro Far East, Inc.

Reexamination Request:
No. 90/002,101, Aug. 3, 1990

Reexamination Certificate for:

| | |
|---|---|
| Patent No.: | **4,271,093** |
| Issued: | **Jun. 2, 1981** |
| Appl. No.: | **90,425** |
| Filed: | **Nov. 1, 1979** |

[30] Foreign Application Priority Data

Nov. 20, 1978 [JP] Japan ..... 53-142177

[51] Int. Cl.[5] ..... F02M 1/16

[52] U.S. Cl. ..... 261/34.1; 261/35; 261/DIG. 68; 261/DIG. 8; 123/187.5 R

[58] Field of Search ..... 261/DIG. 8

[56] References Cited

U.S. PATENT DOCUMENTS

| | | | |
|---|---|---|---|
| 1,116,823 | 11/1914 | Johnson et al. | 261/DIG. 8 |
| 2,713,854 | 7/1955 | Conover | 261/DIG. 68 |
| 3,177,920 | 4/1965 | Phillips | 261/34.1 |
| 3,233,652 | 2/1966 | Phillips | 261/34.1 |
| 3,275,305 | 9/1966 | Nutten | 261/DIG. 8 |
| 3,371,658 | 3/1968 | Turner | 123/187.5 |
| 3,738,622 | 6/1973 | Tuckey | 261/DIG. 68 |
| 3,987,775 | 10/1976 | O'Connor | 123/187.5 |
| 4,197,825 | 4/1980 | Altenbach | 261/DIG. 8 |

FOREIGN PATENT DOCUMENTS

| | | |
|---|---|---|
| 47-21847 | 6/1972 | Japan . |
| 47-38218 | 12/1972 | Japan . |
| 5920868 | 4/1976 | Japan . |

*Primary Examiner*—Tim R. Miles

[57] ABSTRACT

A carburetor having a fuel pump connected to a fuel supply, a fuel inlet valve, a diaphragm-controlled fuel chamber, and a diaphragm to control said fuel inlet valve in response to sub-atmospheric engine pulses, with a manually operable resilient pressure dome to create a sub-atmospheric pressure in the fuel chamber to move said diaphragm to an inlet valve open position and pull fuel into said chamber from a fuel supply to prime said carburetor for cold starts or restarts after fuel depletion.

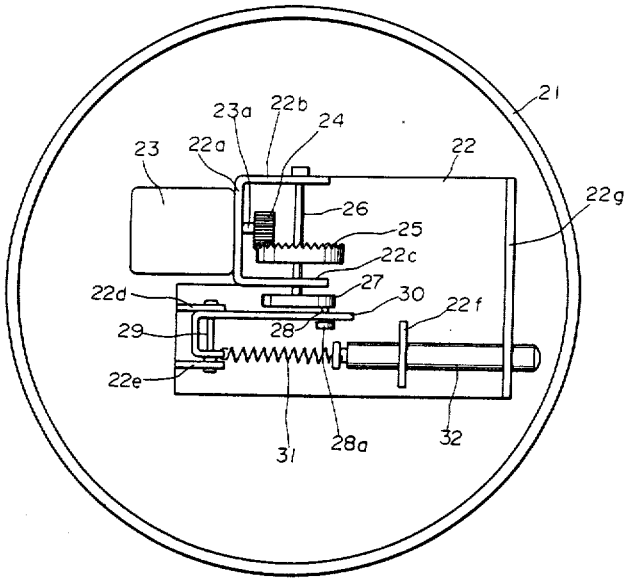

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claim 1 is confirmed.

* * * * *

US004271093B1

REEXAMINATION CERTIFICATE (2316th)

United States Patent [19] [11] B2 4,271,093

Kobayashi [45] Certificate Issued Jun. 14, 1994

[54] CARBURETOR

[75] Inventor: Takeshi Kobayashi, Kawasaki, Japan

[73] Assignee: Harris Trust and Savings Bank, Chicago, Ill.

Reexamination Request:
No. 90/003,007, Mar. 25, 1993

Reexamination Certificate for:
Patent No.: 4,271,093
Issued: Jun. 2, 1981
Appl. No.: 90,425
Filed: Nov. 1, 1979
Reexamination Certificate B1 4,271,093 issued Jan. 22, 1991.

[30] Foreign Application Priority Data

Nov. 20, 1978 [JP] Japan ..... 53-142177

[51] Int. Cl.[5] ..... F02M 1/16
[52] U.S. Cl. ..... 261/34.1; 261/35; 261/DIG. 68; 261/DIG. 8; 123/179.11
[58] Field of Search ..... 261/DIG. 73

[56] References Cited

U.S. PATENT DOCUMENTS

| | | | |
|---|---|---|---|
| 3,275,305 | 9/1966 | Nutten | 261/DIG. 68 |
| 3,371,658 | 3/1968 | Turner | 261/DIG. 8 |
| 3,738,622 | 6/1973 | Tuckey | 261/DIG. 68 |
| 4,197,825 | 4/1980 | Altenbach | 261/DIG. 8 |

FOREIGN PATENT DOCUMENTS

| | | |
|---|---|---|
| 46-32966 | 11/1971 | Japan . |
| 47-5294 | 2/1972 | Japan . |
| 47-21847 | 6/1972 | Japan . |
| 51-41121 | 4/1976 | Japan . |

*Primary Examiner*—Tim R. Miles

[57] ABSTRACT

A carburetor having a fuel pump connected to a fuel supply, a fuel inlet valve, a diaphragm-controlled fuel chamber, and a diaphragm to control said fuel inlet valve in response to sub-atmospheric engine pulses, with a manually operable resilient pressure dome to create a sub-atmospheric pressure in the fuel chamber to move said diaphragm to an inlet valve open position and pull fuel into said chamber from a fuel supply to prime said carburetor for cold starts or restarts after fuel depletion.

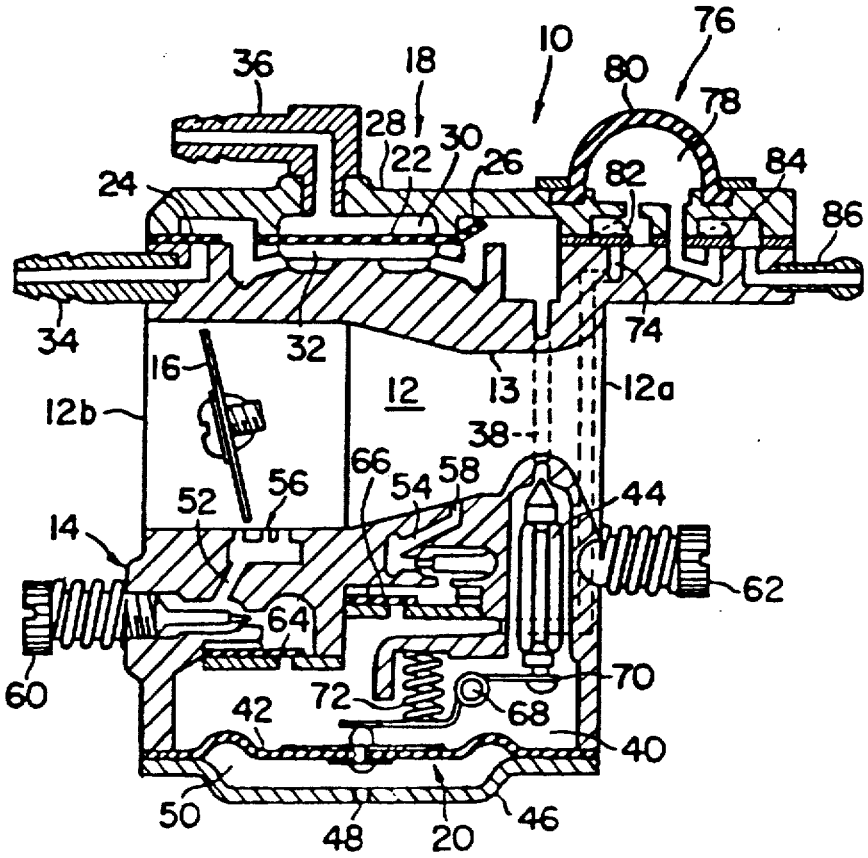

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claim 1 is confirmed.

New claims 2 and 3 are added and determined to be patentable.

*2. In a diaphragm carburetor having a body with a fuel supply port, a diaphrgm chamber open to said fuel supply port formed in said body for supplying fuel to an internal combustion engine through main and idle fuel jets in the carburetor, a check valve communicating with each of said main and idle fuel jets and said diaphragm chamber to prevent reverse flow from said jets to said diaphragm chamber, a diaphragm controlled fuel inlet valve in said body connected to said fuel supply port, a pump chamber in said body, one side of which is formed by the body and the other side of which is formed by a manually compressible resilient dome sealed peripherally against said body and accessible from the outside of said body, a first passage in said body leading from the diaphragm chamber to said pump chamber having a first one-way valve opening in the direction from said diaphragm chamber to said pump chamber, a second passage in said body leading from said pump chamber to an outlet port open to atmosphere having a second one-way valve opening in the direction from said pump chamber to said outlet port, said dome being manually compressible to create a suction in said diaphragm chamber to draw a starting charge of fuel into said diaphragm chamber when said engine is not operating, said first one-way valve serving to block flow through said first passage when said carburetor is operating normally with the engine running.*

*3. In a diaphragm carburetor having a body, a diaphragm pump carried by said body and having a fuel inlet check valve communicating with a fuel inlet and an outlet check valve communicating with a fuel outlet, a fuel supply port in said body communicating with said outlet of said diaphragm pump and said outlet check valve, a diaphragm chamber open to said fuel suppy port formed in said body for suppyling fuel to an internal combustion engine through main and idle fuel jets in the carburetor, a check valve communicating with each of said main and idle fuel jets and said diaphragm chamber to prevent reverse flow from said jets to said diaphragm chamber, a diaphragm controlled fuel inlet valve in said body connected to said fuel supply port, a pump chamber in said body, one side of which is formed by the body and the other side of which is formed by a manually compressible resilient dome sealed peripherally against said body and accessible from the outside of said body, a first passage in said body leading from the diaphragm chamber to said pump chamber having a first one-way valve opening in the direction from said diaphragm chamber to said pump chamber, a second paasage in said body leading from said pump chamber to an outlet port open to atmosphere having a second one-way valve opening in the direction from said pump chamber to said outlet port, said dome being manually compressible to create a suction in said diaphragm chamber to draw a starting charge of fuel into said diaphragm chamber when said engine is not operating, said first one-way valve serving to block flow through said first passage when said carburetor is operating normally with the engine running.*

* * * * *